United States Patent [19]

Giubilo

[11] 4,112,527

[45] Sep. 12, 1978

[54] TEMPORARY STOPPER FOR OUTLETS OF TOILET BOWLS

[76] Inventor: Lauro B. Giubilo, 194 Smallwood Ave., Belleville, N.J. 07109

[21] Appl. No.: 823,873

[22] Filed: Aug. 11, 1977

[51] Int. Cl.[2] ..... A47K 1/14

[52] U.S. Cl. ..... 4/295; 4/257

[58] Field of Search ..... 4/257, 255, 295, 286; 137/356, 400; 251/356

[56] References Cited

U.S. PATENT DOCUMENTS

| | | | |
|---|---|---|---|
| 2,306,444 | 12/1942 | Hubbard | 4/257 |
| 2,894,263 | 7/1959 | Kunkel | 137/356 |
| 2,930,388 | 3/1960 | Biermann | 137/400 |
| 3,105,975 | 10/1963 | Kresel | 4/257 |

*Primary Examiner*—Richard E. Aegerter
*Assistant Examiner*—L. Footland
*Attorney, Agent, or Firm*—Ralph R. Roberts

[57] ABSTRACT

The present invention pertains to a temporary stopper for the outlets of toilet bowls. In particular, this stopper is adapted for installation into and removal from the open top of a toilet bowl and when installed is adapted to stop any and all back flow from a connected sewer. Back flow often occurs when a sewer in addition to its normal discharge is also subject to a flow of water such as may be present after a heavy rain. This may be an infrequent occurrence but does occur in toilet bowls in basements and/or first floor installations. Back flow can and does cause damage and odor proliferation in such installations. A temporary plug that is readily and easily installed to halt such back flow prevents damage and afterward cleanup. The need for such a plug is usually for only a short period of time such as 6 or 12 hours although the time period is not a factor in its use.

9 Claims, 5 Drawing Figures

TEMPORARY STOPPER FOR OUTLETS OF TOILET BOWLS

BACKGROUND OF THE INVENTION

1. Field of the Invention

With reference to the classification of art as established in the United States Patent and Trademark Office the present invention is believed to be found in the general Class entitled, "Fluid Handling" (Class 137) and the subclass entitled, "with static constructional installation" (subclass 356) and the subclass entitled, "with supplemental or safety closing means or bias" (subclass 400). Also of interest is the general Class entitled, "Valves and Valve Actuators" (Class 251) and the subclass entitled, "valve" (subclass 356).

2. Description of the Prior Art

This invention is directed toward a problem which appears to have been largely ignored by the inventors. This is believed to have occurred in part because of the specialized nature of the problem. The present invention is directed toward halting back flow from a sewer or like discharge source. A back flow in a sewer line not only causes a great mess as well as an unpleasant odor but is potentially a health hazard. A pre-Ex search of the prior art was conducted in the above-noted classes and subclasses and pertinent references were not found.

The present invention provides a temporary stopper or valve which is relatively inexpensive, easy to install and remove and is easily adjustable for mounting in a toilet bowl no matter the manufacture, style or vintage year.

SUMMARY OF THE INVENTION

This invention may be summarized in part with reference to its objects.

It is an object of this invention to provide, and it does provide, a hand actuated stopper that is placed into the outlet of a toilet bowl and by a turning and a partial compression of a spring carried by a rod portion of the stopper the plug end of the stopper is tightly fitted into the outlet to close the connected toilet bowl to back flow.

In brief, the hand actuated stopper or plug contemplates a rubber disc about 4 to 4½ inches in diameter and ½ to 1 inch in thickness. This plug is carried on the end of a threaded rod and on the other end of this rod is mounted a handle which in the preferred embodiment has end portions which are readily adjusted as to length. A compression spring extends between the plug and handle. To use this stopper, the operator places a rubber disc so as to cover and close the outlet provided in the bottom of the bowl. The operator presses down on the handle compressing the spring and turns the handle so that the ends thereof are brought under the rim of the bowl. The handle and ends are released and the spring urges the handle into a locked condition and maintains the stopper in position until the operator desires to remove this stopper.

In addition to the above summary the following disclosure is detailed to insure adequacy and aid in understanding of the invention. This disclosure, however, is not intended to cover each concept therein no matter how it may later be disguised by variations in form or additions of further improvements. For this reason there has been chosen a specific embodiment of the temporary stopper as adopted for use with toilet bowls and showing a preferred means for construction. This specific embodiment and alternate embodiments thereof have been chosen for the purpose of illustration and description as shown in the accompanying drawing wherein:

BRIEF DESCRIPTION OF THE DRAWING

In the following description and in the claims various details are identified by specific names for convenience. These names, however, are intended to be generic in their application with corresponding reference characters referring to like members throughout the five figures of the drawing.

Figure 1:
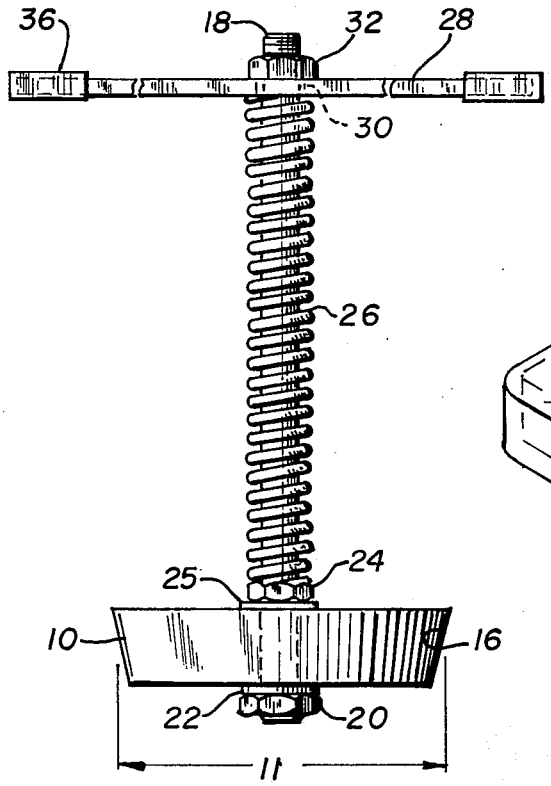
FIG. 1 represents a side view of the temporary stopper and showing a preferred means of constructing the invention.

The drawing accompanying, and forming part of, this specification discloses certain details of construction for the purpose of explanation but it should be understood that these details may be modified in various respects without departure from the invention and that the invention may be incorporated in other structural forms than shown.

DESCRIPTION OF THE PREFERRED EMBODIMENT

Figure 4:
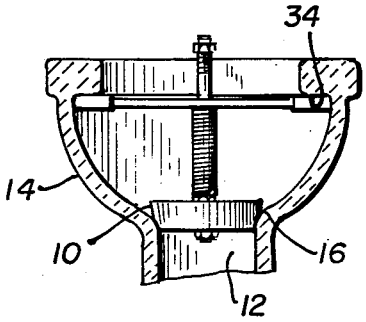
FIG. 4 represents a slightly diagrammatic side view of a toilet bowl and the stopper of this invention in mounted condition.

Referring next to the drawing and FIGS. 1 and 4, there is depicted an assembly of the components forming a temporary stopper for closing the outlet of a toilet bowl. A disc 10 of rubber or like resilient material is formed with a slightly larger outer diameter 11 than the outlets 12 formed in toilet bowl 14. When pressed into the top portion of an outlet 12 of toilet bowl 14, the plug tightly closes this outlet to stop any fluid flow. This outer diameter 11 of disc 10 may have a tapered contour 16, as seen in FIG. 1, and, as reduced to practice, may be 4½ inches in diameter and about 1 inch thick. A threaded rod 18 carries on its lower end the disc 10 which has an appropriately formed substantially central hole which is a sliding fit on the threaded rod.

A lower hex nut 20 and a flat washer 22 are mounted on the lower end of rod 18 and position and retain the disc 10 from dislodgement from the rod 18. A nut 24 and a washer 25 are mounted on rod 18 and provide the upper shoulder or stop for the disc 10. A spring 26 is of a compression-type and is slidably mounted on the rod 18. The lower end of this spring rests on and engages nut 24. The upper end of this spring engages a midportion of a handle 28 which has a hole 30 formed therein. Hole 30 is sized for ready sliding up and down on the rod 18. A nut 32 is depicted as providing the upper stop for the handle 28 as mounted and movable on this shaft. To prevent any damage to the usual porcelain surface of the toilet bowl 14 in general, and an inturned lip 34 in particular, each end of the handle 28 may have a resilient sleeve 36 secured thereto.

USE AND OPERATION

The temporary stopper for an outlet of a toilet bowl is easily installed and removed. The disc 10 is placed on the outlet 12 of the toilet bowl 14. The handle is turned so that the handle 28 is aligned with the lengthwise extent of the bowl. This is usually substantially from front to back. The handle 28 is then pushed down the rod 18 to compress the spring 26 sufficiently for the handle portion to be turned and brought below the lip 34 of the bowl. The handle is then adjusted by manipulation to bring the ends of the handle under the lip portions of the bowl. The handle is now released. The spring 26, with its bias, urges the handle upwardly and the disc 10 downwardly into a fluid shut-off condition. To remove the stopper assembly the handle is pushed toward the plug 10 sufficiently for the handle to be turned from front to back. When the handle is free of the lips 34, the handle is allowed to move to the nut 32 after which the stopper apparatus is lifted from the bowl.

EMBODIMENT OF FIG. 2

Figure 2:
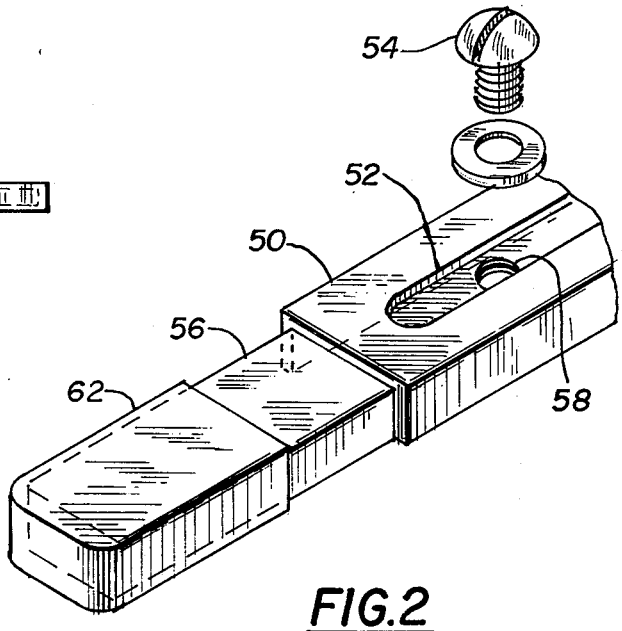
FIG. 2 represents an enlarged, fragmentary, isometric view of a handle formed of an extruded channel and with adjusting handle ends secured as by screws passing through slots.

In FIG. 2 is shown an alternate construction of the handle 28. Since the many makers of toilet bowls have their own ideas, designs and models, the depth and the distance transverse of the toilet bowl may be and does vary from manufacturer to manufacturer and model to model. To accommodate this size variation an alternate handle construction is contemplated. A channel mid-member 50 has a hole formed therein at its midlength. Two slots 52 are formed in the web portion of the channel midmember 50. These slots slidably accommodate the shank of a slot-headed bolt 54. An extending end portion 56 of this handle is slidable in the space between the side portions of the channel. A hole 58 in portion 56 is threaded to engage the bolt 54. A plastic or rubber cap 62 is secured to each extending end portion 56. In the manner of FIG. 1, this handle is used to secure the disc 10 in and at the outlet 12 of the bowl. The adjustable handle of FIG. 2 is made shorter or longer to suit the width of the bowl and the in-turned lip provided therewith.

EMBODIMENT OF FIG. 3

Figure 3:
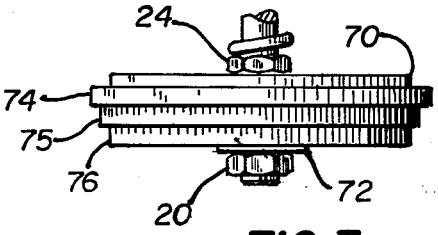
FIG. 3 represents a fragmentary side view in a slightly reduced scale of an alternate plug or stopper construction.

Referring next to FIG. 3, there is depicted an alternate construction of the disc 10, as seen in FIG. 1. As shown in the fragmentary view of FIG. 3, large upper and lower washers 70 and 72 are slidable on threaded rod 18. Nuts 20 and 24 are, or are similar to, like numbered nuts, as seen in FIG. 1, and retain the washers and the resilient discs 74, 75, and 76 on the rod 18. These discs, as reduced to practice, are about one-quarter of an inch thick and about 4½ inches in diameter. The rubber is between 30 and 40 durometer. At this resiliency the discs readily conform to any irregularities in casting or finish and when pressed into position provide a sure seal against back flow of fluid from a connected sewer.

It is to be noted that the spring depicted is approximately 1 inch in pitch diameter and is about 6 inches long. The wire is about ⅛ inch in diameter. The shut height of the spring is at least 3 inches. The spring can be made more or less in length and compressive force, as desired. The rod 18 is shown as a threaded rod but may have only the upper end threaded. The lower end of the rod for retaining the disc may be provided with cotter pins instead of nuts. The disc should not leak at this fitting to the rod.

EMBODIMENT OF FIG. 5

Figure 5:
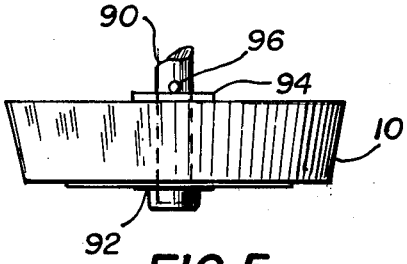
FIG. 5 shows a side view, partly diagrammatic and fragmentary of a smooth rod in which press-on cap washers are mounted to provide end stops.

Referring next and finally to FIG. 5, there is shown an alternate means for providing an end stop on both ends of a rod. Instead of a threaded member as in FIG. 1, the central member may be a smooth rod 90. The upper and lower ends of this rod have mounted thereon a press-on combination cap and washer 92. These are well known devices and are widely used on toys and lightweight carts and the like to hold wheels on shafts. A washer 94 and cotter pin 96 is secured to the rod 90 to provide the upper stop for a disc. The upper combination cap and washer 92 provides the upper limiting stop for a handle. A spring, as above-described, is provided between the handle and the upper retainer of the plug.

Instead of a pin 96 a pair of ear portions in the rod may be formed by a die. These extending ear portions provide a stop for the upward travel of washer 94 and may engage and limit the downward travel of spring 26. This forming of extending ears by a die eliminates the expense of drilling a hole and of a pin or cotter.

At any sign or indication of back flow into the toilet bowl the temporary plug is installed. Removal is made after the need for the shut off has passed. No leaks occur if the sewer system has no leaks and the vent is several feet above the toilet bowl outlet. The bowl is usually tightened against a soft gasket which usually is able to withstand back flow pressure from a few inches to 4 to 6 feet. Pressure greater than this may produce small seeps at a joint. This seepage is much less than 2 or 3 feet of sewage in a first floor or basement. Toilet bowls on the second and above floors are very infrequently subject to sewage back flow.

In any of the above arrangements it is desirable that the hole in the resilient disc 10 or discs 74, 75 and 76 be a tight fit so that no leak occurs by the rod 18 or 90. Such a possible leak or seepage may be prevented by tightening nuts 20 and 24 or by a rubber or like cement. It is only necessary that the disc when pressed into sealing and fluid stopping condition provides a seal against back flow from a connected sewer. The partially compressed spring 26 provides the necessary force to effect a seal of the outlet 12 of the bowl 14.

Terms such as "up", "down", "bottom", "top", "front", "back", "in", "out" and the like are applicable to the embodiments shown and described in conjunction with the drawing. These terms are merely for the purposes of description and do not necessarily apply to the position in which the temporary stopper for toilet bowls may be constructed or used.

While particular embodiments of this temporary stopper have been shown and described it is to be understood the invention is not limited thereto since modifications may be made within the scope of the accompanying claims and protection is sought to the broadest extent the prior art allows.

What is claimed is:

1. A temporary stopper for closing an outlet of a toilet bowl of conventional construction and having a generally oval top and a lip around a substantial portion thereof, the installed stopper preventing unwanted back flow of fluid and the like from a connected sewer, said stopper including: (a) a substantially rigid rod of selected length; (b) a disc member of at least partially resilient material, said disc having a diametrical extent at least slightly larger than the outlet of said bowl, this disc mounted on one end of the rod; (c) means for retaining said disc at the end of the rod and also for retaining this disc so that at its mounting position on the rod and in back flow stopping condition in the bowl the disc is sealed at the rod to inhibit any fluid flow thereby; (d) a handle having a hole at a midportion thereof, this hole sized to provide at least a sliding fit on the rod, the handle of a length less than the long extent of the opening at the top of the bowl and greater than the opening at the shorter transverse opening of the bowl, said handle being a channel member and having end members which members are slidable in this channel to a selected extended condition and means is provided by securing these ends in the selected position, said means including a bolt and nut and a slot slidably accommodating the shank of the bolt, and a through hole sized for the turning therein of the shank of the bolt, the slot formed in one component and the hole in the other component, the midportion of the handle forming one component and an end member providing the other component; (e) a compression spring slidable and carried on and by the rod, this spring disposed between the handle and the means for retaining the disc, the spring bias urging the handle away from the disc, and (f) means for limiting the outward travel of the handle on the rod when a temporary closing of the outlet of the toilet bowl against back flow is achieved by positioning the disc member over the outlet of the bowl and pressing this disc into flow inhibiting condition by moving the handle downwardly on the rod to compress the spring and at this downward position the handle is maneuvered and turned to bring both ends of the handle under a lip portion of the toilet bowl whereat the handle is released with the ends engaged by the lip as and with the spring bias urging and maintaning the disc in a flow sealing condition.

2. A temporary stopper as in claim 1 in which the disc member is of rubber about 1 inch thick and about 4½ inches in diameter.

3. A temporary stopper as in claim 1 in which the disc member is a plurality of discs of similar size, the plurality of discs having a diameter of at least 4 inches and the total thickness being a minimum of one-half inch.

4. A temporary stopper as in claim 1 in which the rod is threaded at least for a short distance from its ends and the means for retaining the disc member is a pair of threaded nuts and washers and the means for limiting the outward travel of the handle is a threaded nut.

5. A temporary stopper as in claim 1 in which the ends of the handle are additionally provided with an affixed at least partially resilient covering to prevent damage to the underlip of the toilet bowl as and when the handle is moved to a stopper securing position.

6. A temporary stopper as in claim 1 in which the outward ends of the end members are additionally provided with an affixed at least partially resilient covering to prevent damage to the underlip of the toilet bowl as and when the handle is moved to a stopper securing position.

7. A temporary stopper as in claim 1 in which the rod is a smooth rod and on each end there is mounted a formed combination washer and retainer, one end combination retainer providing a stop for the handle and the other retainer on the other end providing the outer retainer for the disc member.

8. A temporary stopper as in claim 1 in which the means for retaining the disc is a cotter pin and washer.

9. A temporary stopper for closing an outlet of a toilet bowl of conventional construction and having a generally oval top and a lip around a substantial portion thereof, the installed stopper preventing unwanted back flow of fluid and the like from a connected sewer, said stopper including: (a) a substantially rigid rod of selected length; (b) a disc member of at least partially resilient material, said disc having a diametrical extent at least slightly larger than the outlet of said bowl, this disc mounted on one end of the rod; (c) means for retaining said disc at the end of the rod and also for retaining this disc so that at its mounting position on the rod and in back flow stopping condition in the bowl the disc is sealed at the rod to inhibit any fluid flow thereby; (d) a handle having a hole at midportion thereof, this hole sized to provide at least a sliding fit on the rod, the handle of at least three components which in a retracted condition is of a length less than the long extent of the opening at the top of the bowl and in an adjusted and secured condition the handle is greater than the opening at the shorter transverse opening of the bowl, said handle having a midportion and end portions which are slidable therealong and are fastened at a selected extended condition which is substantially in an alignment and is less than said long extent of the bowl, the fastening of the end to the handle midportion including a bolt and nut and a slot slidably accommodating the shank of the bolt, and a through hole sized for the turning therein of the shank of the bolt, the slot formed in one component and the hole in the other component, the midportion of the handle forming one component and an end member providing the other component; (e) a compression spring slidable and carried on and by the rod, this spring disposed between the handle and the means for retaining the disc, the spring bias urging the handle away from the disc, and (f) means for limiting the outward travel of the handle assembly on the rod when a temporary closing of the outlet of the toilet bowl against back flow is achieved by positioning the disc member over the outlet of the bowl and pressing this disc into flow inhibiting condition by moving the handle assembly downwardly on the rod to compress the spring and at this downward position the handle is maneuvered and turned to bring both ends of the handle under a lip portion of the toilet bowl whereat the handle assembly is released with the ends engaged by the lip as and with the spring bias urging and maintaining the disc in a flow sealing condition.

* * * * *